US005913709A

United States Patent [19]

Cyr et al.

[11] Patent Number: 5,913,709

[45] Date of Patent: Jun. 22, 1999

[54] SOUND-PRODUCING GOLF CLUB

[75] Inventors: Terry J. Cyr, Palo Alto; Terry J. Sanchez, Half Moon Bay; James R. Livesey, Los Gatos, all of Calif.

[73] Assignee: OddzOn, Inc., Napa, Calif.

[21] Appl. No.: 08/881,474

[22] Filed: Jun. 24, 1997

[51] Int. Cl.[6] ..... A63H 5/00

[52] U.S. Cl. ..... 446/418; 473/324

[58] Field of Search ..... 473/324, 329, 473/327, 332, 559; 446/418, 421, 416

[56] References Cited

U.S. PATENT DOCUMENTS

| | | | |
|---|---|---|---|
| D. 343,664 | 1/1994 | Maguire . | |
| 519,770 | 5/1894 | McNaughton . | |
| 870,041 | 11/1907 | Lundberg . | |
| 1,113,162 | 10/1914 | Murphy . | |
| 1,744,862 | 1/1930 | Blethen . | |
| 3,048,399 | 8/1962 | Breitbach . | |
| 3,162,443 | 12/1964 | Petri . | |
| 3,173,688 | 3/1965 | Green . | |
| 3,561,760 | 2/1971 | Klay . | |
| 4,148,483 | 4/1979 | Sweet et al. . | |
| 4,274,634 | 6/1981 | Berluti . | |
| 4,330,124 | 5/1982 | Vettorello . | |
| 4,340,224 | 7/1982 | Staats . | |
| 4,343,468 | 8/1982 | Lindgren . | |
| 4,443,013 | 4/1984 | Burt . | |
| 4,836,543 | 6/1989 | Holzer . | |
| 4,840,371 | 6/1989 | Harris | 446/404 X |
| 4,844,478 | 7/1989 | Kessler . | |
| 4,891,175 | 1/1990 | Haines . | |
| 5,064,197 | 11/1991 | Eddy | 473/329 X |
| 5,080,374 | 1/1992 | Yu . | |
| 5,160,147 | 11/1992 | Ping . | |
| 5,179,255 | 1/1993 | Yeh . | |
| 5,188,359 | 2/1993 | Wu . | |
| 5,217,222 | 6/1993 | Rudell et al. . | |
| 5,409,213 | 4/1995 | Yeh . | |
| 5,505,453 | 4/1996 | Mack | 473/329 |

FOREIGN PATENT DOCUMENTS

| | | |
|---|---|---|
| 282936 | 2/1966 | Australia . |
| 1148576 | 6/1983 | Canada . |
| 3817464A1 | 11/1989 | Germany . |
| 1750709-A1 | 7/1992 | Russian Federation . |
| 1383949 | 2/1975 | United Kingdom . |
| WO 94/21334 | 9/1994 | WIPO . |

*Primary Examiner*—Kien T. Nguyen

*Attorney, Agent, or Firm*—Kolisch, Hartwell, Dickinson, McCormack & Heuser

[57] ABSTRACT

A golf club is provided with an elongate shaft portion and a club head coupled to the shaft portion. The club head holds an impact surface designed to strike a ball when the club is swung at the ball. The impact surface, club head and shaft all cooperate to produce a drum-like tone when the ball is struck. The club head includes front face with a platform and a clamp that mate and hold the impact surface therebetween. The platform is provided with a raised ridge or brace that is surrounded by the clamp. When the platform and clamp are assembled together, the impact surface is tensioned by the brace to make the impact surface an audibly vibratory member. The club head is hollow within to augment the sound produced by the impact surface and has a plurality of ports to an interior cavity to further augment the sound.

15 Claims, 4 Drawing Sheets

SOUND-PRODUCING GOLF CLUB

BACKGROUND AND SUMMARY OF THE INVENTION

This invention relates to a golf club, and in particular to such a golf club with a head that includes a membrane-like impact surface held by a frame and which produces a sound like a drum being struck when the club is used to strike a ball.

An important object of the invention is to offer a golf club which will be used by children in a golf-like game, and which will add a new, audible dimension to such a game. The amusing sound that the golf club makes with each striking of the ball expands the game from mere hitting of the ball for distance and accuracy into an exciting sound-producing sport.

Another object of the invention is to provide a golf club that is small and lightweight so that small children can use it. The head is made much larger than ordinary, making striking the ball easy for even very young children and the frame is angled slightly upwardly so that the ball is lifted in an arc when struck and propelled forward. The golf club is thus more attractive to children.

According to a preferred embodiment of the invention, now about to be described in more detail, the golf club includes an elongate, shaft formed of lightweight plastic or wood with a hand grip at one end. The club includes a head, attached at an end of the shaft opposite the hand grip, for striking the ball. The head extends at an oblique angle from the shaft and has a bulbous shape, as in a conventional golf club driver. However, unlike existing golf clubs, the hitting surface of the head is a membrane-like impact surface which is held in place by a frame made of lightweight plastic.

The frame includes a hollow body with a flat, upwardly angled front face and a curved, bulbous back. The front face of the body has a roughly rectangular shape. On the face, an annular platform surrounds an opening through the front face into the body. The platform includes an annular ridge or brace along the inner edge of the platform surrounding the opening. The impact surface is sized and shaped to fit over the opening with an outer skirt extending over the annular brace. Just outside the brace, a series of screw bosses are embedded in the platform. An annular clamp, configured to surround the brace, includes a complementary series of countersunk screw holes. The impact surface is held in place between the clamp and platform, which are attached by screws, and tensioned by tightening the screws to stretch the impact surface over the brace. If properly tensioned, the impact surface vibrates at an audible frequency when struck.

The shaft, frame, and impact surface, when coupled together, form a hollow drum, with the impact surface providing the tensioned, vibratory membrane and the body, which includes ports on the back, providing the sound chamber which is acoustically coupled to the impact surface. When the impact surface strikes a ball, the surface vibrates at an audible frequency causing a sympathetic vibration in the body and the shaft, thus producing a drum-like tone that sustains for several seconds. When the frame or shaft strikes a ball, a similar, sustained, drum-like tone is also produced. An advantage is that the simple sport of striking a ball gains a new, sound-producing dimension that will attract more children into an exciting and physical exercise.

The attractiveness of the club for use by small children is further enhanced by the light weight and the large head. The ease and fun of playing golf with the club of the present invention builds the child's interest in sports and confidence in the child's own abilities.

The golf club is also provided with a tee assembly to support the ball above the ground prior to striking. The tee assembly is provided with a base so that it may be used on any surface. A tee, formed of a woven mesh of plastic fibers, is attached to the base. The tee is roughly cone-shaped with a pointed end embedded in the base and an open end adapted to support the ball. The tee provides further emulation of the game of golf for the child and also raises the ball to a level where striking the ball is easier.

These and other objects, advantages and features which are offered by the present invention will become more fully apparent as the description that now follows is read in conjunction with the accompanying drawings.

DETAILED DESCRIPTION OF THE INVENTION

Figure 1:
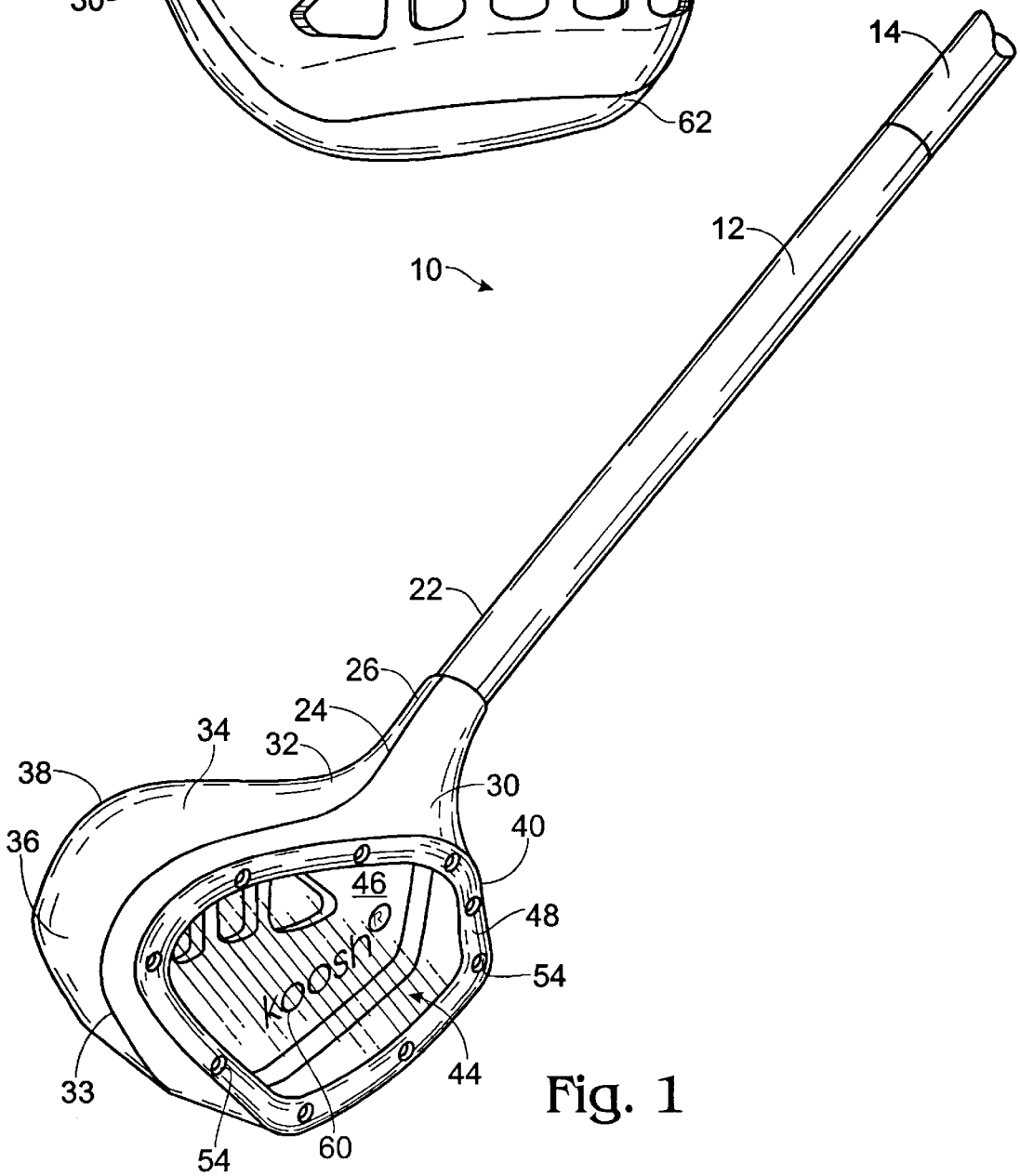
FIG. 1 is a perspective view illustrating a golf club constructed in accordance with the present invention with a shaft, frame, and impact surface.

Turning attention now to the drawings, and referring, initially, to FIG. 1, a golf club according to the present invention is indicated generally at 10. Club 10 includes an elongate shaft 12 with a hand grip 14 at one end. The shaft may be formed of any suitable material such as wood or hollow, lightweight plastic. The hand grip may be a sleeve formed of a suitable material such as plastic and fitted over the shaft, or, may be formed as an integral part of the shaft.

At an end 22 of the shaft opposite hand grip 14, a striking portion, such as club head 24, which includes a fastening section 26, is coupled to the shaft, preferably by gluing. Club head 24 is formed of lightweight plastic that is molded in two sections, a front section 30 and a back section 32 joined by suitable means, such as sonic welding, at a seam 33. Club head 24 includes a frame 34 with a substantially hollow, bulbous body 36 with a curved back 38. Frame 34 also has a flat, angularly inclined front face 40 with an opening 44 into body 36 that defines an impact region.

Impact region 44 is spanned by an impact surface, such as membrane 46 that is preferably formed separately from the frame and preferably made of mylar or other plastic. The impact surface is held in place adjacent frame 34 by being pinched or clamped between a clamp 48 and a platform 50, best seen in FIG. 2. Screws, such as screw 52, installed in nine pre-formed holes 54 in clamp 48 and through pre-formed holes 56 in impact surface 46 into screw bosses 58 in platform 50, hold the impact surface in place between the clamp and platform. The impact surface may alternatively be coupled to the frame by other means such as gluing, stapling, or welding. Preferably, platform 50 and clamp 48 substantially surround impact surface 46 and impact surface 46 spans the entire impact region. Alternatively, platform 50 and clamp 48 may surround impact surface 46 only partly or impact surface 46 may span less than all of impact region 44.

The impact surface is capable of striking and propelling a ball on a generally horizontal playing surface such as a lawn, floor, or street when a user swings the golf club into the ball. When the ball is struck, preferably by impact surface 46 directly but alternatively by frame 34 or shaft 12, the impact surface, frame, and shaft cooperate to produce a sound. The impact surface is held under tension in the frame so the sound has tonal characteristics similar to the sound that a drum emits when it is struck. The sound or tone sustains for a period of time before dying away. In the disclosed embodiment, impact surface 46 is made of a substantially transparent material which can be marked with indicia 60 to identify a child's team or the source of the golf club.

Figure 2:
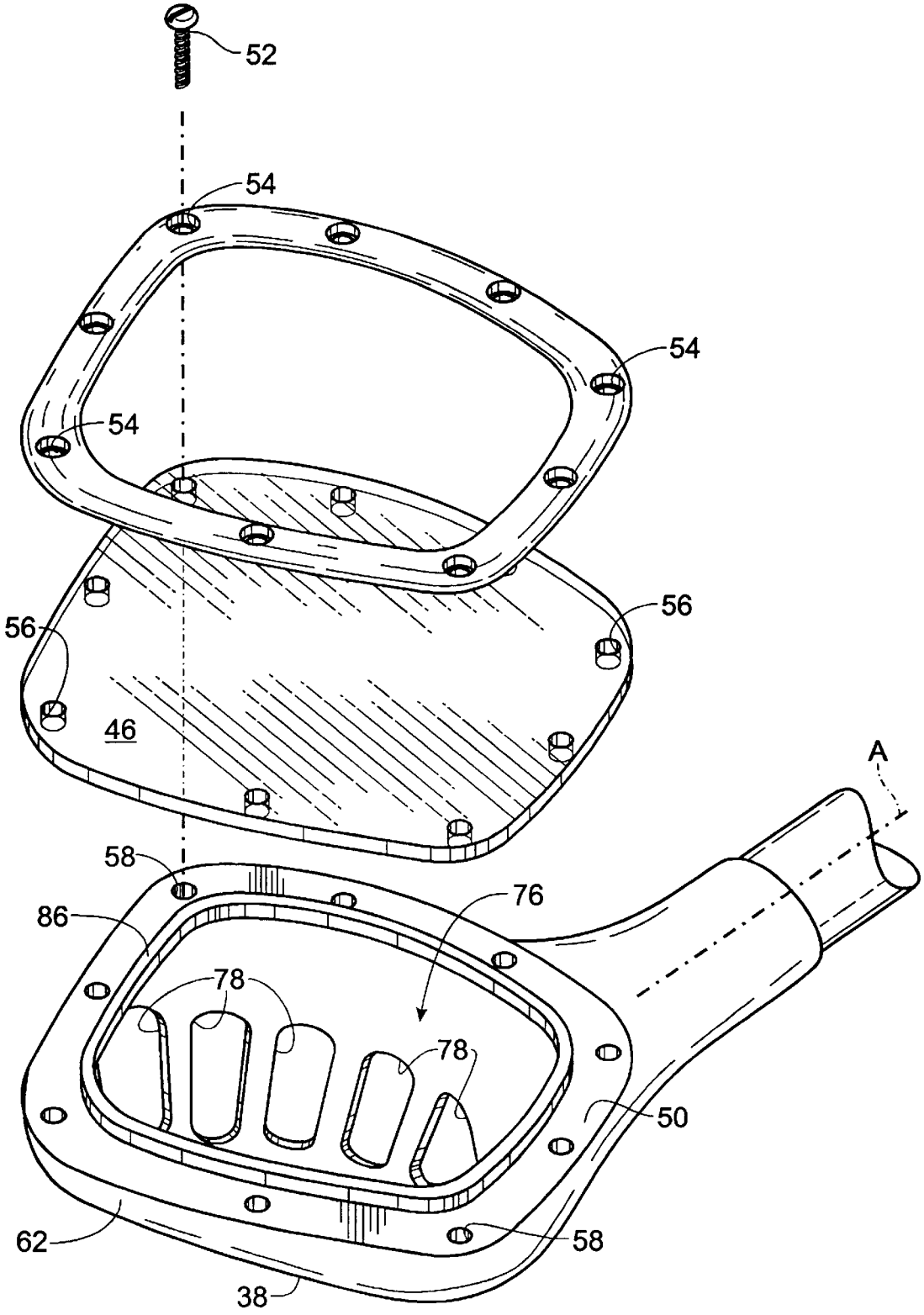
FIG. 2 is a partial, exploded perspective view of the golf club of FIG. 1 showing the assembly of the clamp and platform with screws through holes in the clamp into bosses in the platform.
Figure 3:
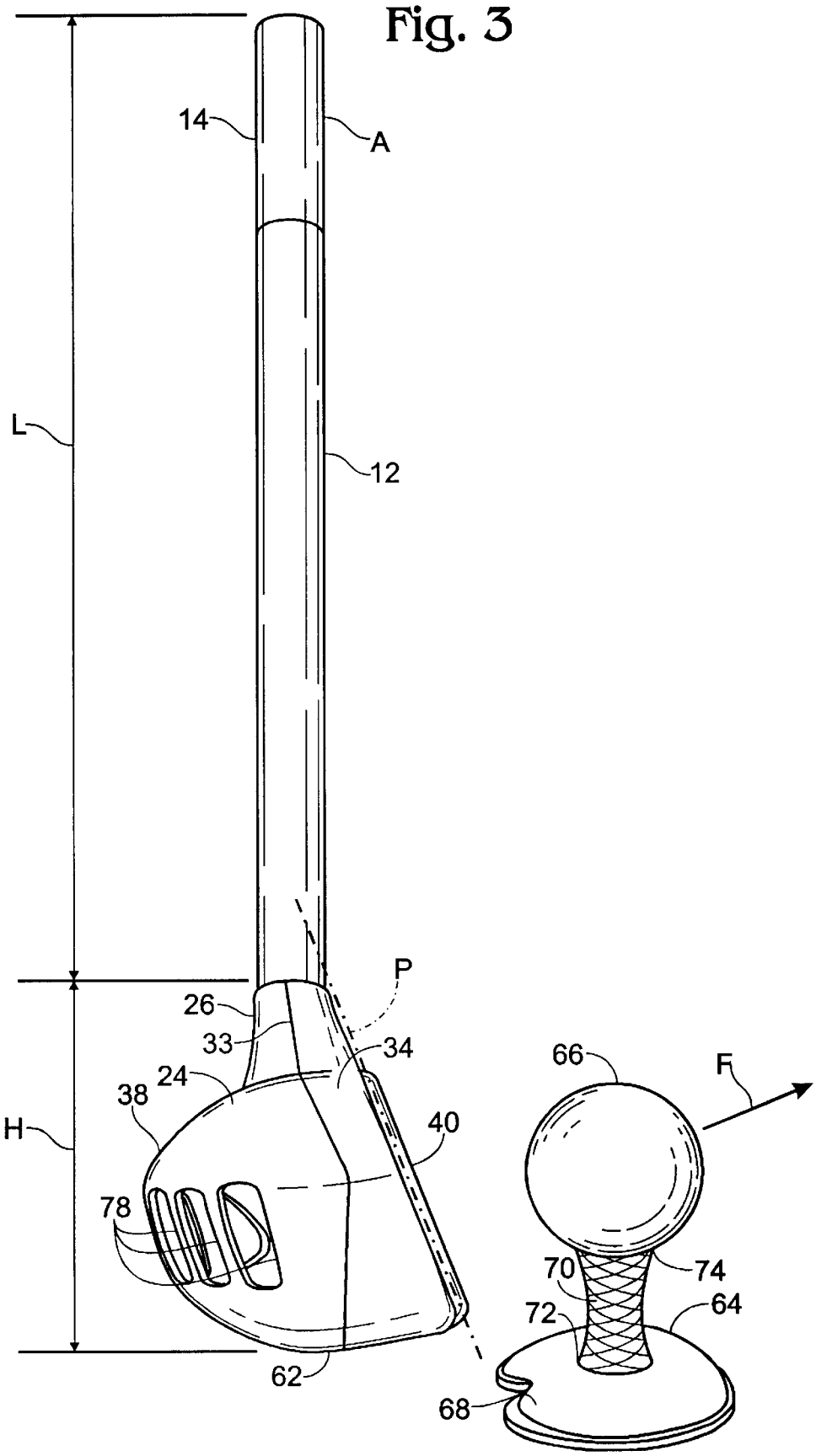
FIG. 3 is a side view of the golf club of FIG. 1 shown with a tee and a ball set up in the tee.

As shown in FIG. 2, frame 34 includes a substantially straight bottom edge 62 that is angularly offset relative to the longitudinal axis A of the shaft. As best seen in FIG. 3, head 24 has a height H defined from the top of connecting portion 26 to bottom edge 62. Shaft 12 has a length L defined along its longitudinal axis. The shaft's length is greater than the height of the head and preferably is at least two times the height of the head. The ratio used in the disclosed embodiment is a shaft portion's length about three times the head's height. The size for the club in the disclosed embodiment is a shaft portion's length of about 20-inches and a head's height of about 7-inches. In use, as best seen in FIG. 3, a child holds the club at hand grip 14 so that bottom edge 62 of frame 34 extends down to the lawn, floor, or street. In such a playing stance, the bottom edge is easily held substantially parallel and in close proximity to the floor, lawn, or street.

FIG. 3 shows that front face 40 of frame 34 lies in a plane P that is angularly offset from longitudinal axis A of shaft 12. A tee assembly 64 is used to raise a ball 66 off the ground. Tee assembly 64 includes a styrofoam base 68, that is adaptable to most surfaces, and a tee 70, formed of a woven mesh of plastic fibers, attached to the base. Tee 70 is roughly cone-shaped with a pointed end 72 embedded in the base and an open end 74 adapted to support the ball. When a child strikes ball 66 with club head 24, the angular offset of the front face provides lift to the ball to propel the ball on an upwardly arcing flight path F.

The hollow interior of club head 24 defines a cavity 76, best seen in FIG. 2. The cavity is advantageous in enhancing the sound produced by the club both because air resonates in the cavity and because the cavity makes the head more light weight and thus more responsive to the vibrations of the impact surface. The air resonating in cavity 76 emanates through five ports 78 in back 38 of body 36 further enhancing the sound produced by the club.

Figure 4:
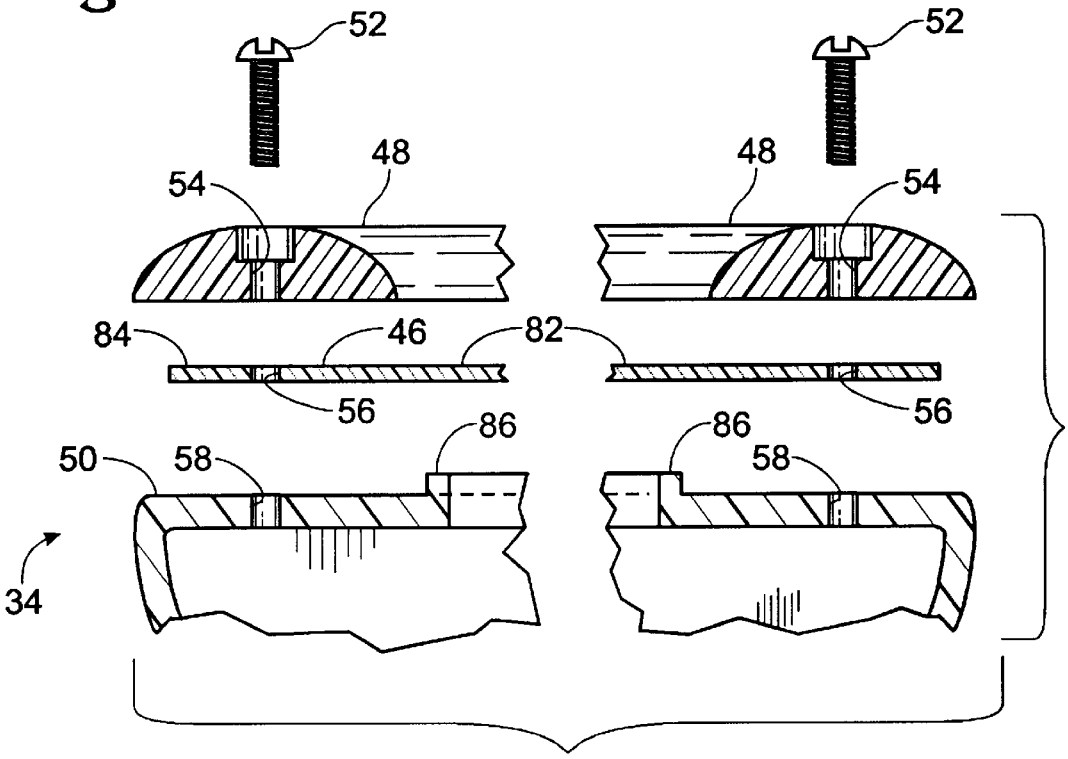
FIG. 4 is a cross-sectional, exploded view of the golf club of FIG. 1 showing an edge of the impact surface between a clamp and a platform.
Figure 5:
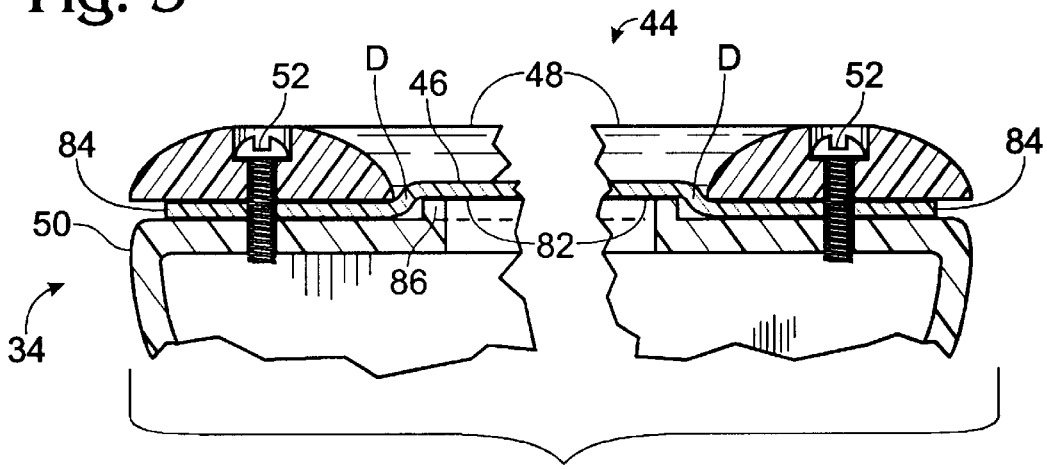
FIG. 5 is a cross-sectional view similar to that of FIG. 4 but with the clamp and platform assembled together, holding the edge of the impact surface.

FIGS. 4 and 5 show the connection of impact surface 46 to frame 34. Impact surface 46 includes a central hitting surface 82 and a skirt 84 preferably surrounding the entire central hitting surface, but alternatively surrounding at least a part of the central hitting surface. The skirt extends over a brace, such as raised ridge 86, on platform 50 and includes holes 56 aligned with complementary holes 54 and bosses 56 in clamp 48 and platform 50, respectively. When assembled, as shown in FIG. 5, screws 52 press clamp 48 down onto platform 50 with skirt 84 trapped therebetween. Impact surface 46 deforms, as shown at D, as it is bent over brace 86, causing central hitting surface 82 to be stretched slightly and tensioned over impact region 44 so that the surface will vibrate at audible frequencies when used to strike a ball. The holding of the impact surface by the frame also serves to couple the frame acoustically to the impact surface so that a vibration in one will cause a sympathetic vibration in the other resulting in the capability of the club to produce a drum-like tone.

Figure 6:
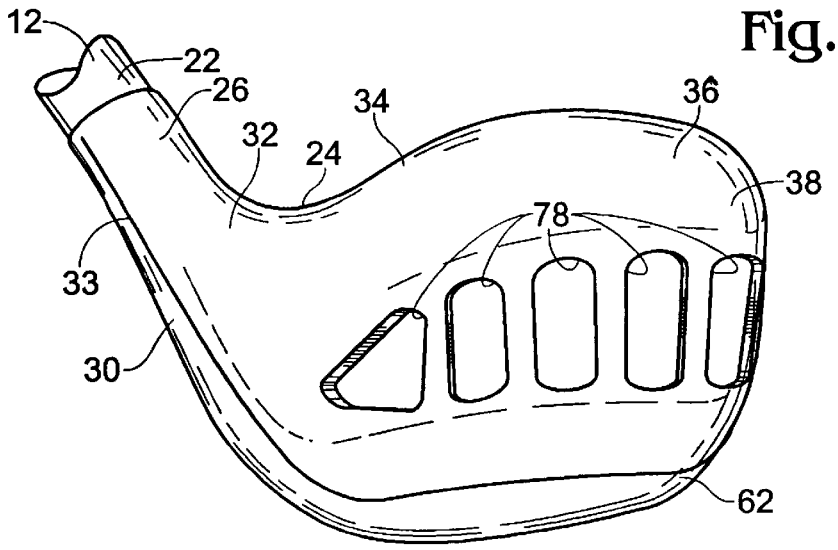
FIG. 6 is a rear view of the golf club of FIG. 1 showing a curved back of the head with ports into the hollow interior of the head.

Using screws to tighten the clamp onto the impact surface is especially advantageous because it provides a controlled, mechanical advantage for tightening skirt 84 over brace 86 to stretch and tension the impact surface. The bosses in the disclosed embodiment are threaded inserts, but alternatively, self-threading screws may be used with non-threaded inserts or directly in non-threaded holes drilled in platform 50. FIG. 6 shows the varying shapes of the ports 78 for hollow body 36 that allow sound resonating in cavity 76 to emanate from the cavity.

While the present invention has been shown and described with reference to the foregoing operational principals and preferred embodiment, it will be apparent to those skilled in the art that other changes in form and detail may be made therein without departing from the spirit and scope of the invention as defined in the appended claims.

It is claimed and desired to secure by Letters Patent:

1. A golf club for producing a sound, the club comprising:

an elongate shaft;

a golf club head adjacent an end of the shaft, the club head defining including a connecting portion connecting the head to the elongate shaft, the club head further including a bottom edge, where the club head has a height from the connecting portion to the bottom edge and where the length of the shaft is greater than the height of the club head, and wherein the club head defines an aperture which surrounds an impact region; and a membrane spanning at least a portion of the impact region, the membrane being held in place adjacent the aperture, wherein the membrane is capable of striking and propelling a ball, and, wherein the membrane and the club head cooperate to produce sound when the membrane strikes the ball.

2. The golf club of claim 1 wherein the club head includes a platform around the impact region, the platform including a raised brace adjacent the impact region, and wherein the club head further includes a clamp attachable to the platform around the brace, the clamp configured to hold the membrane.

3. The golf club of claim 2 wherein the membrane includes a skirt extending substantially beyond the brace and the clamp is configured to be tightened onto the platform, thereby capturing the skirt between the platform and the clamp and stretching the membrane over the brace.

4. The golf club of claim 1 wherein the club head includes a substantially hollow interior defining a cavity.

5. The golf club of claim 4 wherein the club head includes a port configured to allow sound waves to emanate from the cavity.

6. The golf club of claim 5 wherein the club head includes a pluraliity of varyingly shaped ports.

7. The golf club of claim 1 wherein the aperture includes a bottom edge that is angularly offset relative to the shaft so that the bottom edge may be held substantially parallel to a horizontal playing surface when the golf club is in use.

8. The golf club of claim 1 wherein the club head has a height, the shaft has a length, and the shaft's length is greater than the club head's height.

9. The golf club of claim 8 wherein the shaft's length is at least two times the club head's height.

10. The golf club of claim 1 wherein the shaft defines a longitudinal axis and the membrane lies in a plane angularly offset from the longitudinal axis of the shaft whereby the membrane, when used to strike a ball and propel the ball forward, is configured to provide lift to the ball.

11. The golf club of claim 1 wherein the membrane is formed separately from the club head and is coupled to the club head.

12. The golf club of claim 1 further comprising a grip adjacent an end of the shaft opposite the club head.

13. A golf club for striking a ball and producing a sound, the club comprising:

an elongate shaft; and a striking portion adjacent the shaft, the striking portion including a frame defining an impact region, the frame including a platform substantially surrounding the impact region, the platform including a brace extending around at least a part of the impact region, the frame further including a clamp configured to be attached to the platform alongside the brace, the striking portion further including a membrane having a central hitting surface and a skirt substantially surrounding the central hitting surface, the skirt configured to extend over the brace and to be held between the brace and clamp so the membrane is held by the frame across at least a part of the impact region, and wherein the membrane and frame produce the sound when the ball is struck.

14. The club of claim 13 wherein the platform and clamp further include a plurality of pre-formed, complementary screw holes and bosses and further comprising screws adapted to secure the platform and clamp together and hold the membrane across the impact region.

15. A golf club for striking a ball and producing a sound, the club comprising:

an elongate shaft; and a striking portion adjacent the shaft, the striking portion including a frame defining an impact region, the frame including a platform with a brace and a clamp attachable to the platform alongside the brace, the platform having screw bosses and the clamp having complementary screw holes, the screw bosses being adjacent the brace, the striking portion further including a membrane held between the platform and clamp, the striking portion further including screws for securing the platform and clamp together, and wherein the membrane and frame produce the sound when the ball is struck.

* * * * *